US009198487B2

(12) United States Patent
Bisserier

(10) Patent No.: US 9,198,487 B2
(45) Date of Patent: Dec. 1, 2015

(54) ARTICLE OF JEWELRY HAVING ARTICULATED ELEMENTS

(76) Inventor: Claude Bisserier, Oak Park, CA (US)

( * ) Notice: Subject to any disclaimer, the term of this patent is extended or adjusted under 35 U.S.C. 154(b) by 113 days.

(21) Appl. No.: 13/992,211

(22) PCT Filed: Dec. 6, 2011

(86) PCT No.: PCT/US2011/063609

§ 371 (c)(1),
(2), (4) Date: Jun. 6, 2013

(87) PCT Pub. No.: WO2012/078685

PCT Pub. Date: Jun. 14, 2012

(65) Prior Publication Data

US 2013/0263627 A1 Oct. 10, 2013

Related U.S. Application Data

(60) Provisional application No. 61/420,294, filed on Dec. 6, 2010.

(51) Int. Cl.
*A44C 9/00* (2006.01)
*A44C 13/00* (2006.01)

(52) U.S. Cl.
CPC . *A44C 9/00* (2013.01); *A44C 9/003* (2013.01); *A44C 13/00* (2013.01)

(58) Field of Classification Search
CPC ..... A44C 9/00; A44C 9/0053; A44C 15/00; A44C 25/001; A44C 25/004; A44C 25/002
USPC ..... 63/15, 31, 30, 29.1, 29.2, 26–28
See application file for complete search history.

(56) References Cited

U.S. PATENT DOCUMENTS

| | | | | |
|---|---|---|---|---|
| 419,251 | A * | 1/1890 | Goff | 63/28 |
| 3,365,877 | A * | 1/1968 | Altman | 368/285 |
| 3,805,549 | A * | 4/1974 | Nielsen | 63/31 |
| 2005/0166634 | A1 | 8/2005 | Lieberman et al. | |
| 2005/0188512 | A1 | 9/2005 | Ninomiya | |
| 2008/0016913 | A1 | 1/2008 | Ray et al. | |
| 2009/0133439 | A1 * | 5/2009 | Kwong | 63/3.1 |

FOREIGN PATENT DOCUMENTS

KR 10-2005-0107350 11/2005

OTHER PUBLICATIONS

International Search Report for Serial No. PCT/US2011/063609 mailed Jul. 9, 2012.

* cited by examiner

*Primary Examiner* — Jack W Lavinder
(74) *Attorney, Agent, or Firm* — Brooks Acordia IP Law, P.C.; Pejman Yedidsion; Christopher Weiss

(57) ABSTRACT

An article of jewelry comprising an assembly of rotatable elements, the assembly may be loaded by a resilient member, and stowed and deployed via a depressible plunger having a detent. Rotatable elements comprise eyelets and rotatable elements of the assembly deploy via longitudinal travel from the base, beyond a portion of a base retaining rim, and rotate about a retaining ring threading an eyelet of each of the rotatable elements.

7 Claims, 10 Drawing Sheets

ARTICLE OF JEWELRY HAVING ARTICULATED ELEMENTS

CROSS-REFERENCE TO RELATED APPLICATIONS

This application is a 371 of International Application No. PCT/US2011/063609 filed Dec. 6, 2011, which claims priority to and the benefit of U.S. Provisional Patent Application Ser. No. 61/420,294, filed Dec. 6, 2010, the disclosures of which are hereby incorporated by reference in their entirety herein for all purposes.

TECHNICAL FIELD

The present invention pertains to jewelry ring assemblies and particularly to a resiliently loaded annular element holder having an array of articulated elements.

SUMMARY

Embodiments comprise a ring assembly that comprises: (a) a plunger comprising a base portion and a cap portion, where the cap portion is configured to engage longitudinally the base portion via at least one of: a detent and a cap portion protrusion configured to laterally engage a base portion slot; (b) a rotational element array assembly slideably disposed concentrically about the plunger base portion; and (c) a resilient element interposed between the rotational element array and a base; and where the rotational element array assembly comprises a plurality of rotational structural elements wherein at least one of the plurality rotational elements that may comprise: (i) a first aperture, and a second aperture, wherein the second aperture is disposed along a first lever arm portion of the at least one rotational structural element distal from the first aperture; (ii) a first ring threading the first aperture; and a second ring threading the second aperture; where the first ring is interposed between a first lever arm guide and a second lever arm guide; and where the second ring is interposed between a third lever arm guide and a fourth lever arm guide. In some embodiments the first aperture is a first eyelet and the second aperture is a second eyelet. In some embodiments, the at least one of the plurality of rotational structural elements comprises a portion extending from a portion of the rotational structural element proximal to the first aperture in a direction away from the base. The ring assembly base portion of the plunger may comprise a detent where the detent is configured to change positional state via longitudinal depression of the cap portion of the plunger. The base of the the ring assembly may further comprise a restraining rim configured to retain the rotational element array assembly in a retracted position for a depressed plunger cap portion, and wherein the restraining rim is further configured to rotationally and elevationally guide the rotational element array assembly relative to the base responsive to a deployed plunger cap portion and wherein the longitudinal travel of the rotational element array assembly relative to the base is motivated by a load of the resilient element. In some embodiments of the ring assembly: (a) the first lever arm guide may comprise a groove portion configured to retain laterally the first lever arm and an abutment portion configured to retain a portion of the first ring; (b) the second lever arm guide may be configured to engage the first lever arm guide via an interstitial space and retain the first ring via an interdigitated housing portion formed via the first lever arm guide engaging the second lever arm guide; (c) the third lever arm guide may comprise a groove portion configured to retain the first lever arm and an abutment portion configured to retain a portion of the second ring; and (d) the fourth lever arm guide may be configured to engage the third lever arm guide via an interstitial space and retain the second ring via an interdigitated housing portion formed via the third lever arm guide engaging the fourth lever arm guide.

DETAILED DESCRIPTION

Figure 1:
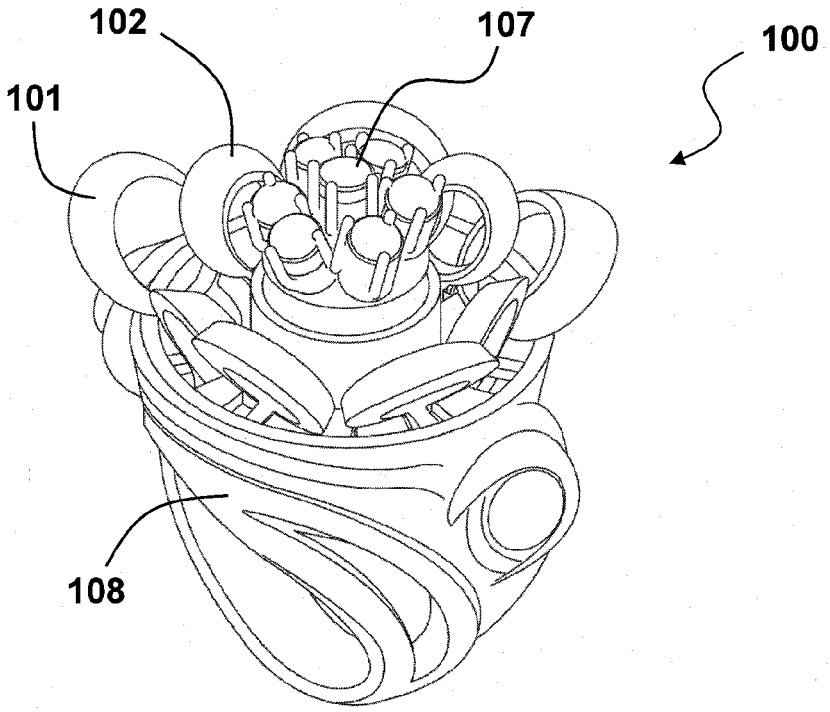
FIG. 1 depicts an exemplary article of jewelry embodiment.

FIG. 1 depicts an exemplary article of jewelry 100. This exemplary article of jewelry may comprise an annular array of hinged elements 101,102 disposed about an optional centerpiece 107. This optional centerpiece may be comprised of a series of elements, e.g., several precious stones, or a single mounted element, e.g., a diamond. This exemplary article may be mounted on a ring 108, e.g., a necklace, or a brooch.

Figure 2:
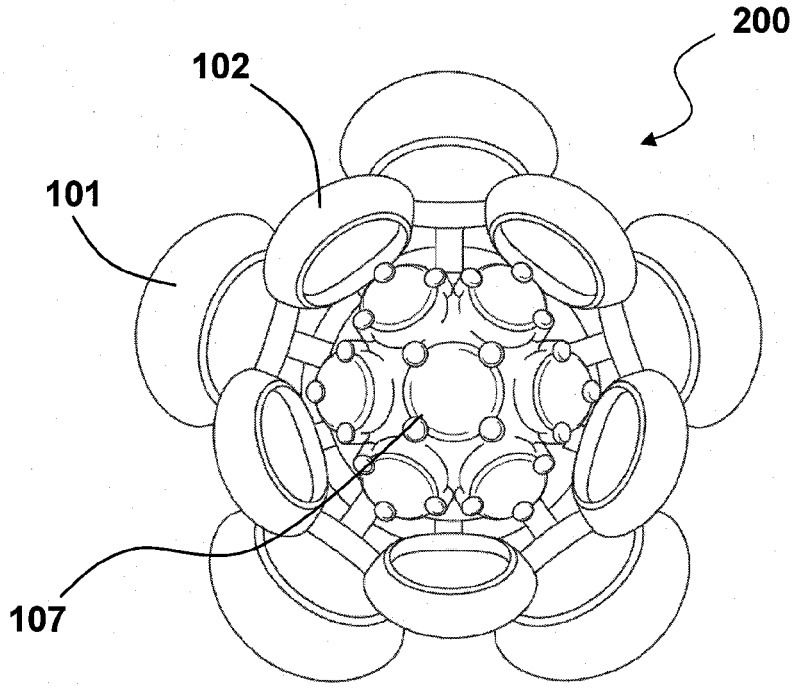
FIG. 2 is a top view of an exemplary article of jewelry embodiment in an open state.

FIG. 2 is a top view of an exemplary article of jewelry 200 in an open state. In some exemplary embodiments, the article of jewelry may comprise two sets, or circular arrays, of hinged elements 101, 102: an outer set of hinged elements 101 and an inner set of hinged elements 102. In some exemplary embodiments, an outer hinged element 101 may alternate, e.g., in a staggered fashion, with an inner hinged element 102 to form an annular array about an optional centerpiece 107. Exemplary embodiments may include an even number of outer hinged elements 101 and inner hinged elements 102. In other exemplary embodiments, there may be an uneven number of outer hinged elements 101 and inner hinged elements 102, for example, five outer hinged elements 101 and three inner hinged elements 102. In an exemplary embodiment with an uneven number of outer hinged elements 101 and inner hinged elements 102, the hinged elements 101,102 may be configured and disposed so as to substantially mate in the gaps of the other hinged elements 101,102.

Figure 3:
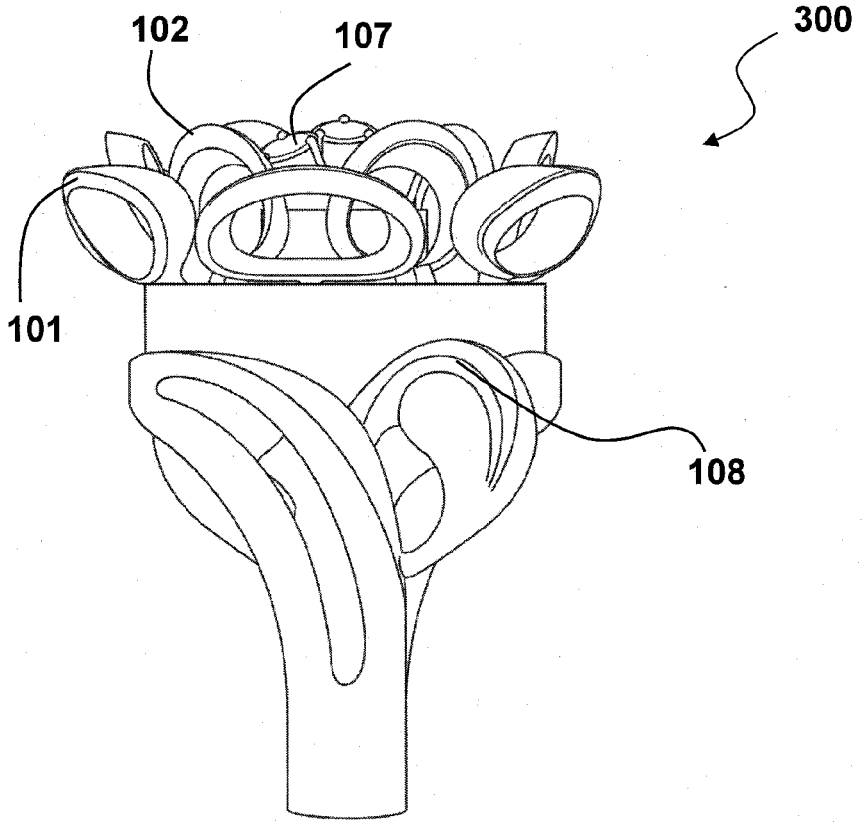
FIG. 3 is a side view of an exemplary article of jewelry embodiment.

FIG. 3 is a side view of an exemplary article of jewelry 300. The hinged, longitudinally translatable, elements 101,102 are depicted in this figure as being in a closed position.

Figure 4:
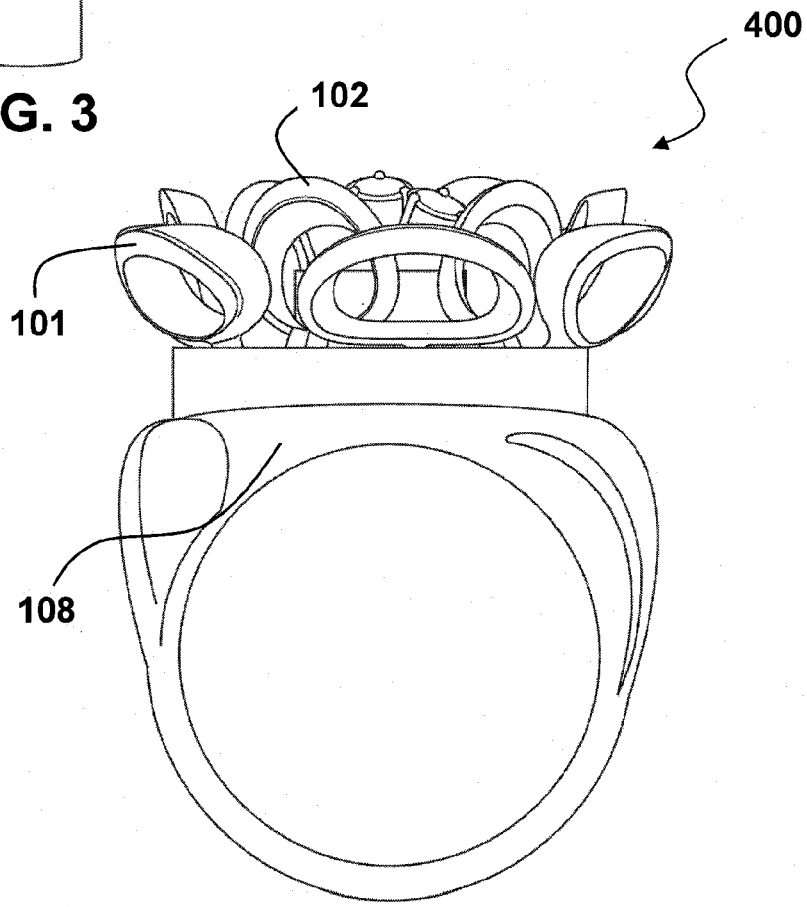
FIG. 4 is a front view of an exemplary article of jewelry embodiment.

FIG. 4 is a front view of an exemplary article of jewelry 400. The hinged elements 101, 102 are depicted in this figure as being in a closed position.

Figure 5:
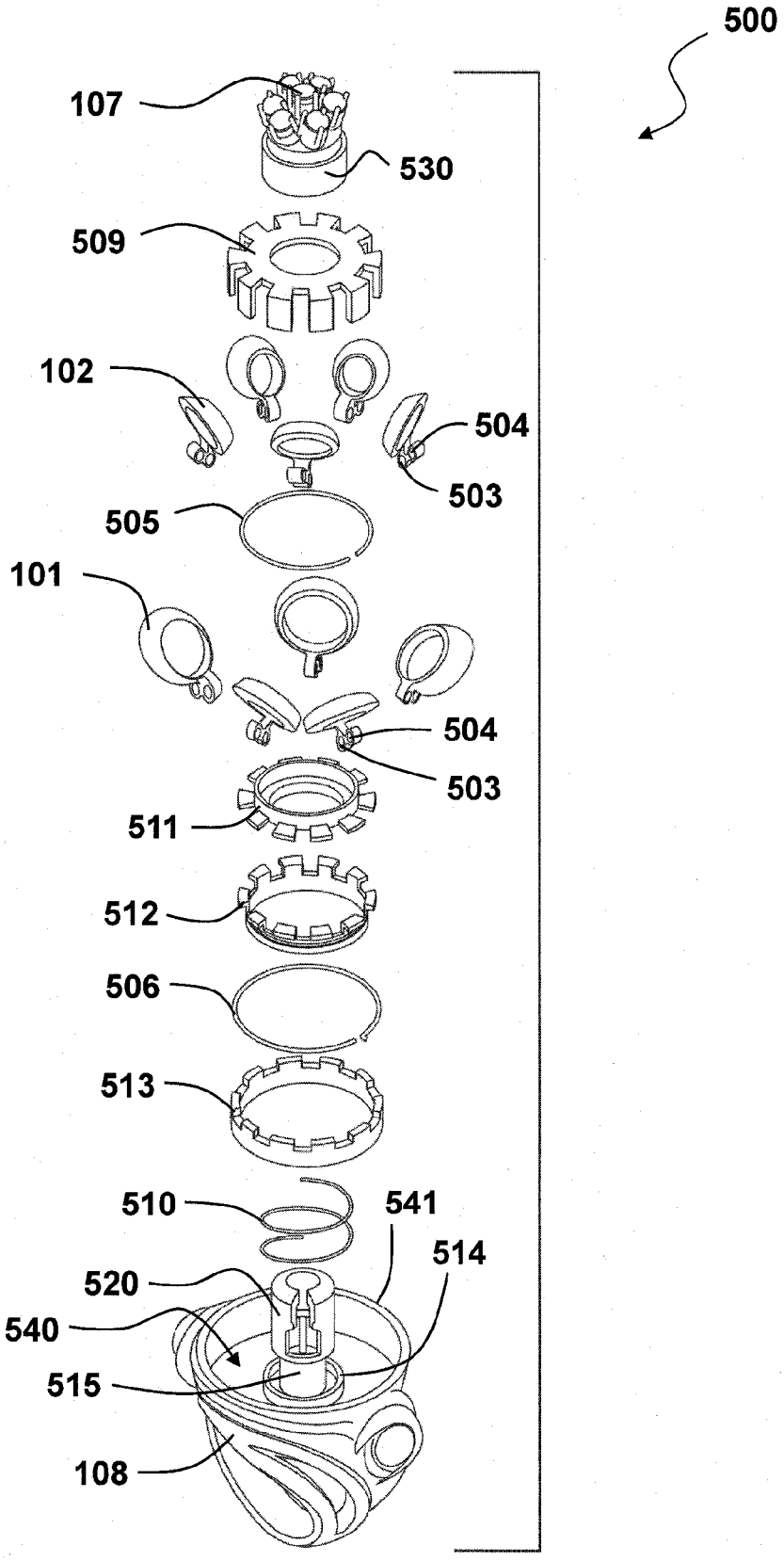
FIG. 5 is an exploded view of an assembly of an exemplary article of jewelry embodiment.

FIG. 5 is an exploded view of an assembly of an exemplary article of jewelry 500. Accordingly, the exemplary article of jewelry may be made of one or more metals and/or alloys, and may be mounted on an ornamental ring 108. A plunging element 520 may be disposed about a base element 515 in the center of the base 540 of an ornamental ring 108. A resilient element 510, e.g., a spring, may be disposed about a rim 514. A fourth flange 513 may translate as a sleeve as to a third flange 512 where a second annular element or ring 506 may be disposed between the fourth flange 513 and the third flange 512. The third flange 512 may be connected to the ornamental ring 108 so that the edges of the third flange 512 are flush with the rim 541 of the ornamental ring 108.

A second positioning element 511 may engage a first positioning element 509 securing a first annular element or ring 505. The second positioning element 511 and the first positioning element 509 may be attached to the plunging element 520. An optional centerpiece 107 may also be attached to the cap 530 of the plunging element 520 by a pin. A rotatable element may comprise a first aperture 503 and a second aperture 504 displaced by a lever arm.

Figure 6:
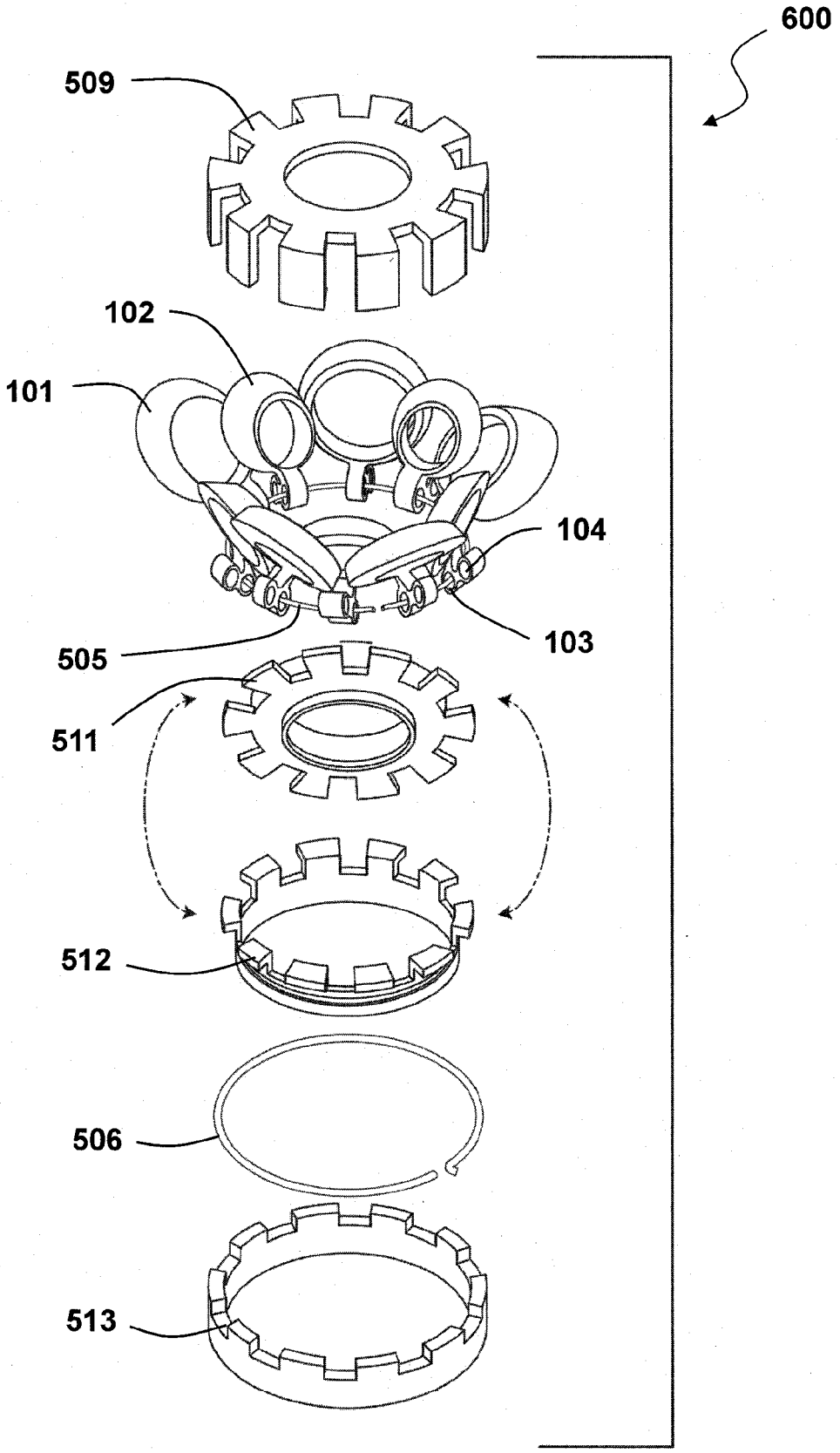
FIG. 6 is an exploded view of an assembly of an exemplary article of jewelry embodiment.

FIG. 6 is an exploded view of an assembly of an exemplary article of jewelry 600. Each hinged element 101, 102 may comprise two apertures, or eyelets, 103,104: a first eyelet 103 and a second eyelet 104. These two eyelets and the structural distance between them may comprise a levering arm, where the first eyelet 103 provides the distal point of the levering arm. The hinged elements 101,102 may be connected in an annular array by threading the first eyelet 103 of the hinged elements 101,102 through a first annular element 505, e.g., a first wire, and the second eyelet 104 of the hinged elements 101,102 through a second annular element or ring 506, e.g., a second wire. The outer hinged elements 101 may be threaded alternatively with the inner hinged elements 102. The first annular element or ring 505 may be soldered at each end to form a closed path. The second annular element or ring 506 may have each end turned up, e.g., an end portion turned at a ninety degree angle relative to the principal path of travel of the wire, so as to provide slack or compression on the hinged elements 101,102.

The exemplary embodiments as depicted by example in the exploded views of FIG. 5 and FIG. 6 may comprise a ring assembly that comprises: (a) a plunger comprising a base portion 520 and a cap portion 530, wherein the cap portion 530 is configured to engage, longitudinally, the base portion 520 via at least one of: a detent and a cap portion protrusion configured to laterally engage a base portion slot; (b) a rotational element array assembly slideably disposed concentrically about the plunger base portion 520; and (c) a resilient element 510 interposed between the rotational element array and a base 514; and where the rotational element array assembly 513 may comprise a plurality of rotational structural elements 101,102 where at least one of the plurality of rotational elements may comprise: (i) a first aperture 503, and a second aperture 504, where the second aperture is disposed along a first lever arm portion of the at least one rotational structural element distal from the first aperture 503; (ii) a first ring threading the first aperture 503; and a second ring threading the second aperture 504; where the first ring is interposed between a first lever arm guide and a second 509 lever arm guide 511; and where the second ring 506 is interposed between a third lever arm guide 512 and a fourth lever arm guide 513. In some embodiments the first aperture 503 may be a first eyelet and the second aperture 504 may be a second eyelet. In some embodiments, the at least one of the plurality of rotational structural elements 101,102 may comprise a portion extending from a portion of the rotational structural element proximal to the first aperture 503 in a direction away from the base 504. The ring assembly base portion of the plunger 520 may comprise a detent where the detent is configured to change positional state via longitudinal depression of the cap portion 530 of the plunger. The base of the ring assembly may further comprise a restraining rim 541 configured to retain the rotational element array assembly 600 in a retracted position for a depressed plunger cap portion 530, and wherein the restraining rim 541 may be further configured to rotationally and elevationally guide the rotational element array assembly 600 relative to the base 540 and responsive to a deployed plunger cap portion 530 and wherein the longitudinal travel of the rotational element array assembly relative to the base 540 is motivated by a load of the resilient element 510. In some embodiments of the ring assembly 500: (a) the first lever arm guide 509 may comprise a groove portion configured to retain laterally the first lever arm and an abutment portion configured to retain a portion of the first ring 505; (b) the second lever arm guide 511 may be configured to engage the first lever arm guide 509 via an interstitial space and retain the first ring via an interdigitated housing portion formed via the first lever arm guide engaging the second lever arm guide 511; (c) the third lever arm guide 512 may comprise a groove portion configured to retain the first lever arm and an abutment portion configured to retain a portion of the second ring 506; and (d) the fourth lever arm guide 513 may be configured to engage the third lever arm guide 512 via an interstitial space and retain the second ring 506 via an interdigitated housing portion formed via the third lever arm guide 512 engaging the fourth lever arm guide 513.

Figure 7:
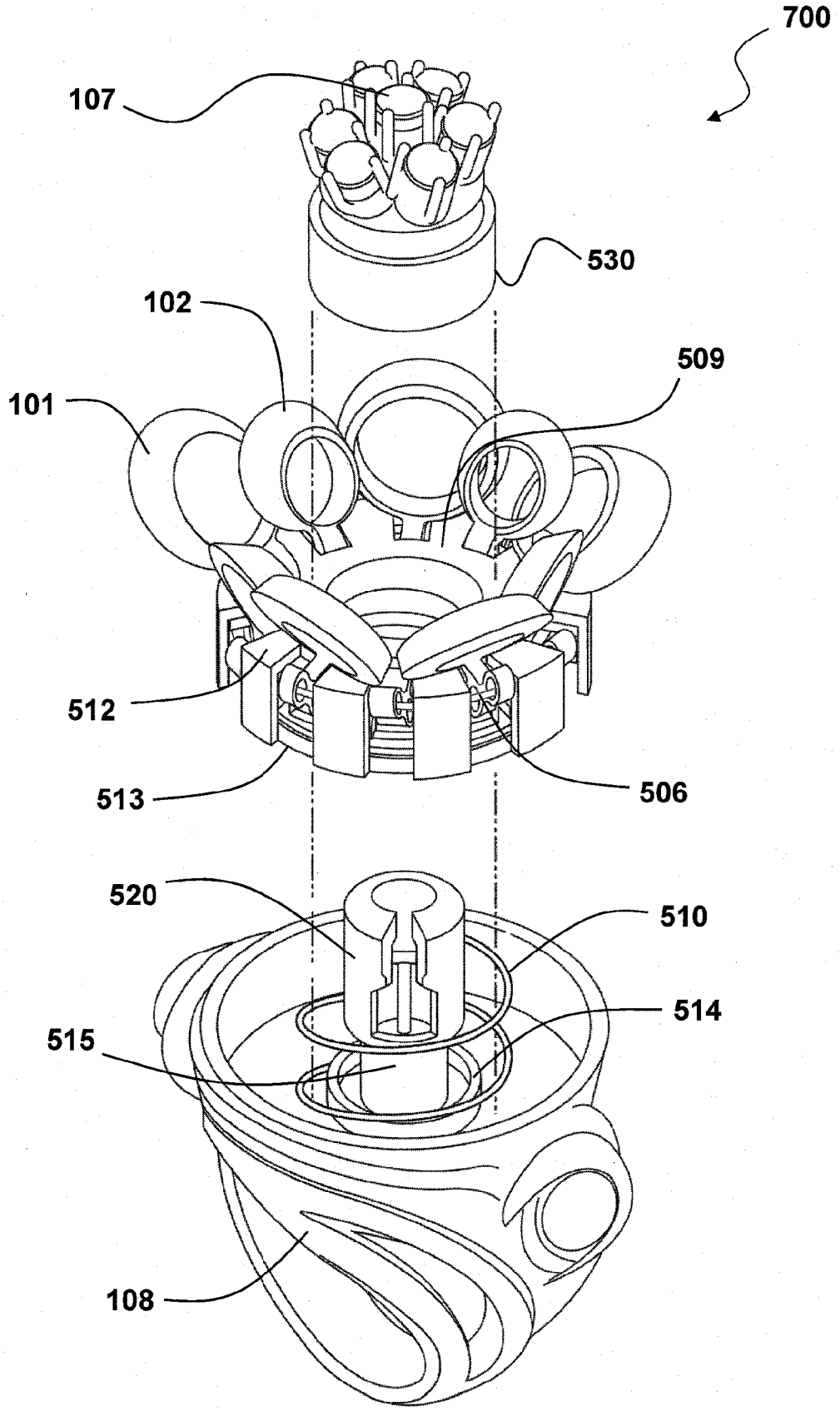
FIG. 7 is an exploded view of an assembly of an exemplary article of jewelry embodiment.

FIG. 7 depicts, in an exploded view, an assembly of an exemplary article of jewelry embodiment 700 and may be viewed in light of FIG. 4. As depicted in FIG. 5, a first position element 509, the inner hinged elements 102, the first annular ring 505, the outer hinged elements 101, and the fourth flange element 513, are disposed and may be assembled to engage the plunging element 520. An optional centerpiece 107 may also be attached to the cap 530 of the plunging element 520. Additionally, as depicted in FIG. 5, the third flange 512, the second annular ring 506, and the fourth flange 513 are assembled to be attached to an ornamental ring 108. The third flange 512 may be flush with the rim of the ornamental ring 108, and may be secured by means such as conventional soldering or laser soldering. The resilient element 510 may be disposed about the plunging element 520 and may be wrapped around a base rim 514 to prevent the resilient element 510 from slipping under the plunging element 520. The plunging element 520 may move longitudinally between the plunger base element 515 and the base rim 514 for example by the amount exerted by a finger, where the finger pressure may be applied to the top or cap 530 of plunging element 520 and/or to the optional centerpiece 107.

Figure 8:
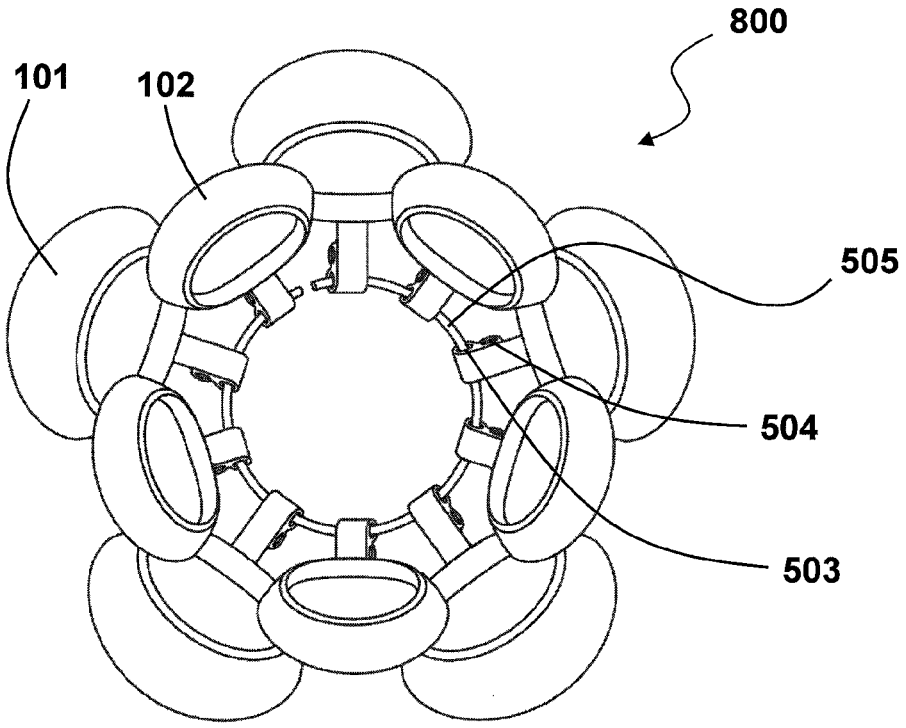
FIG. 8 depicts an assembly of hinged elements on an annular element of an article of jewelry embodiment.

FIG. 8 depicts an assembly 800 of hinged elements 101, 102 on a first annular element 505. The first annular element 505 is threaded through the first eyelet 503 of the hinged elements 101,102. The ends of the first annular element 505 may be soldered together to prevent the removal of any of the hinged elements 101,102.

Figure 9:
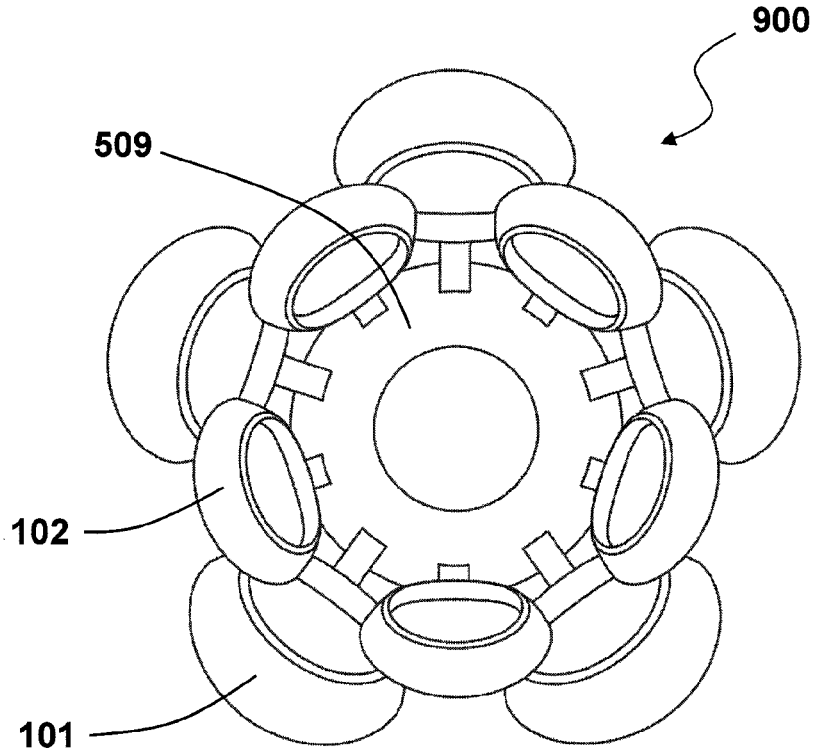
FIG. 9 depicts an assembly of hinged elements on an annular element engaged on a top part of a mode of assembly of an article of jewelry embodiment.

FIG. 9 depicts an assembly of hinged elements on an annular element engaged on a top part of an exemplary mode of assembly 900. Element 509, is depicted in FIG. 9 as engaged over hinged elements 101,102.

Figure 10:
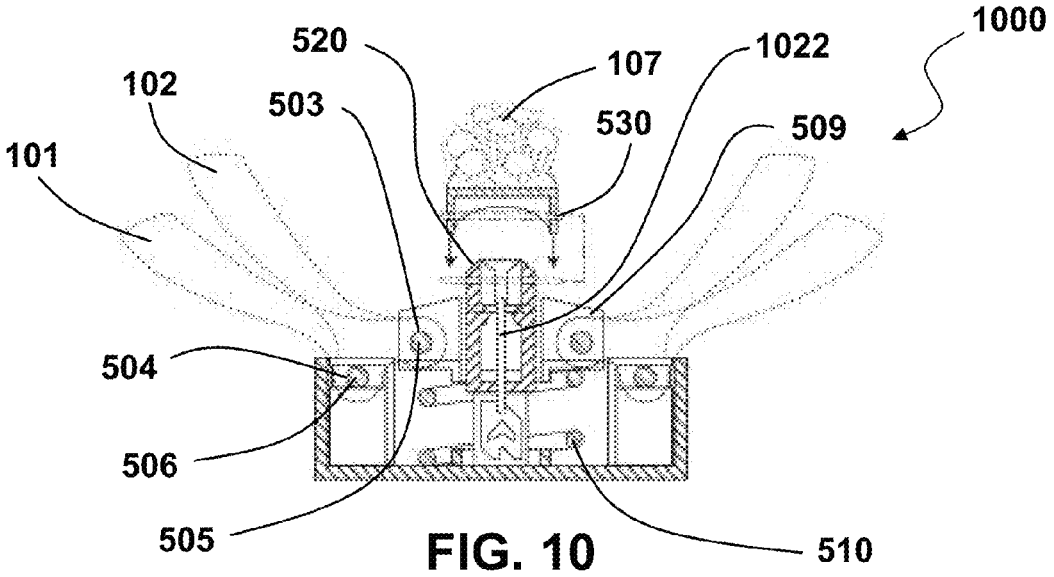
FIG. 10 is a cross-sectional view of an exemplary article of jewelry embodiment in an open state.

FIG. 10 is a cross-sectional view of an exemplary article of jewelry 1000 in an open state. The hinged elements 101, 102 are engaged in an open position. A pin 1022 may be used to secure the optional centerpiece 107 to the plunging element 520.

Figure 11:
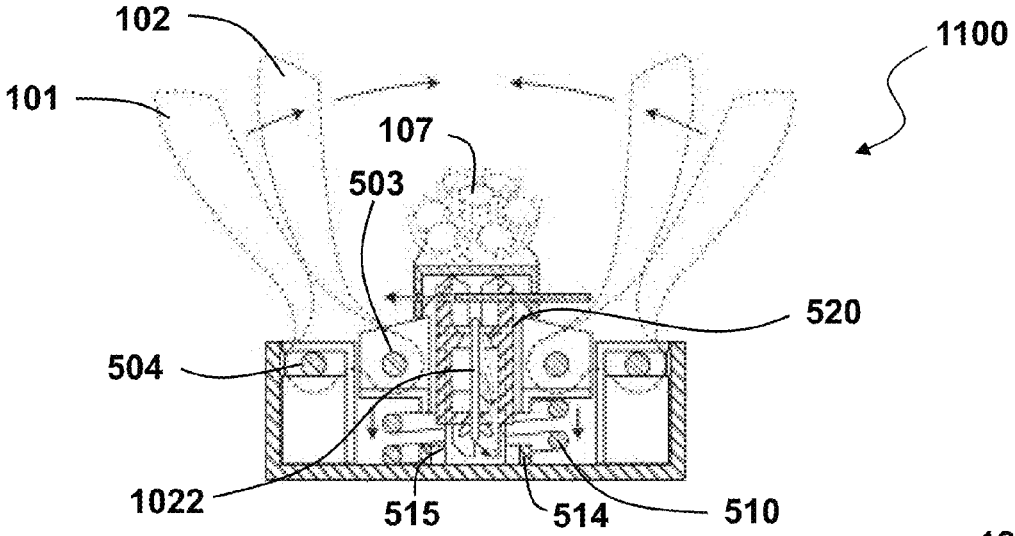
FIG. 11 is a cross-sectional view of an exemplary article of jewelry embodiment in a closed state.

FIG. 11 is a cross-sectional view of an exemplary article of jewelry 1100 in a closed state. The hinged elements 101,102 are being moved from an open position to a closed position.

Figure 12:
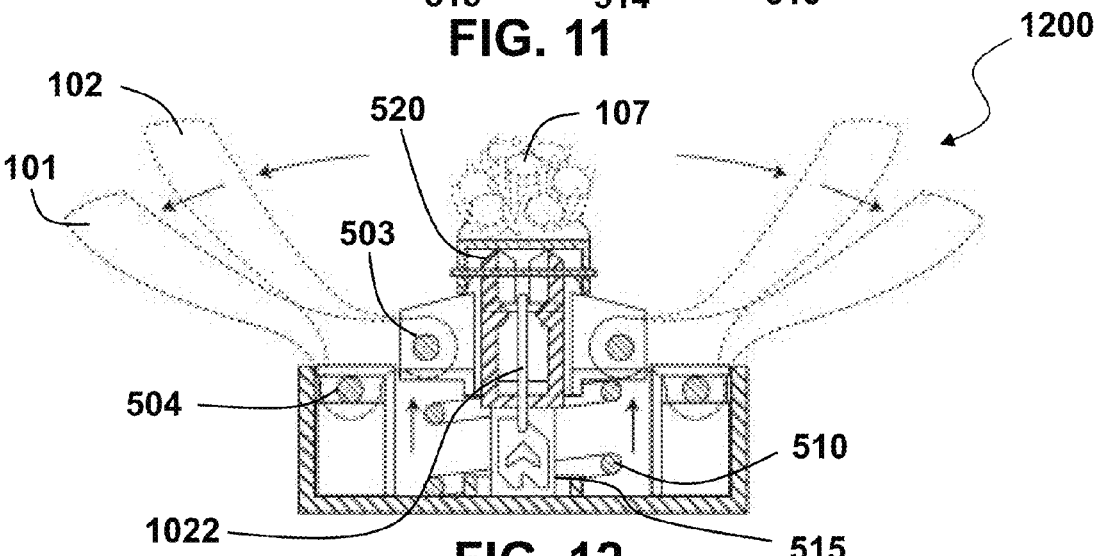
FIG. 12 is a cross-sectional view of an exemplary article of jewelry embodiment in a closed state moving to an open state.

FIG. 12 is a cross-sectional view of an exemplary article of jewelry 1200 in a closed state moving to an open state. The hinged elements 101,102 are being moved from a closed position to an open position.

Figure 13:
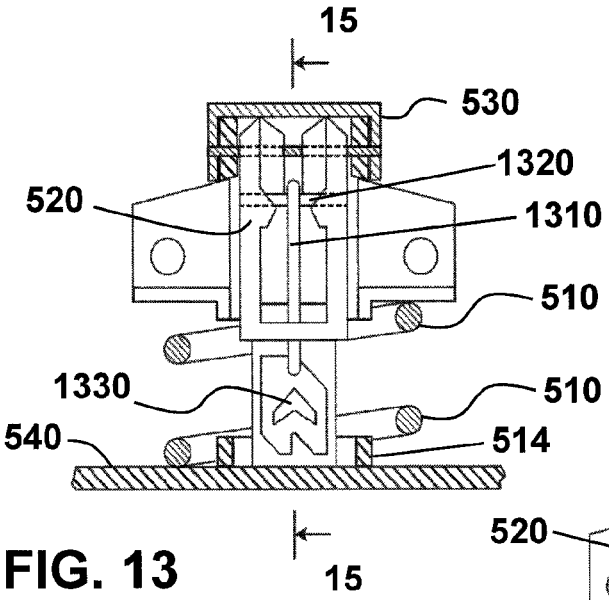
FIGS. 13-16 depict in cross-sections, an exemplary detent plunger.
Figure 14:
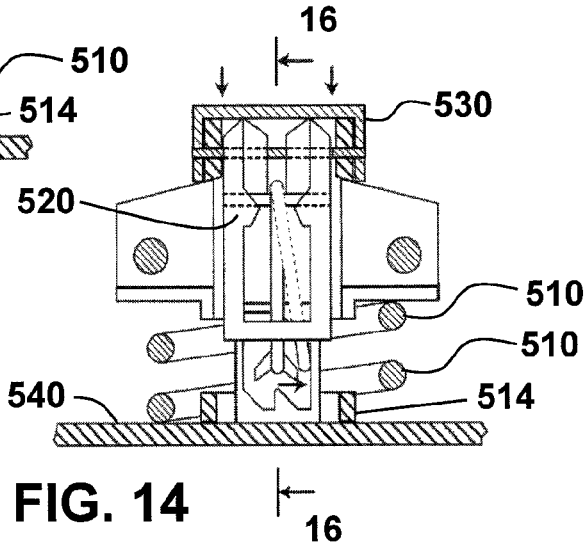
Figure 15:
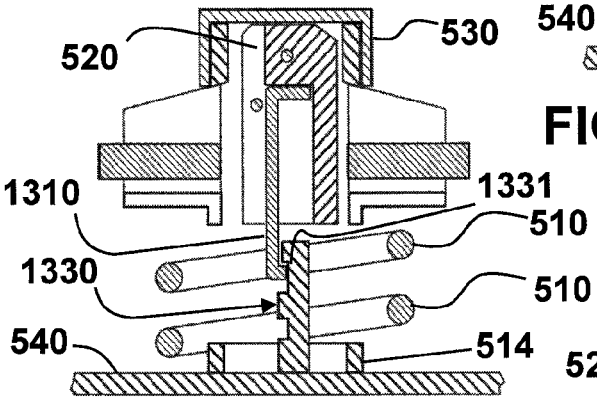
Figure 16:
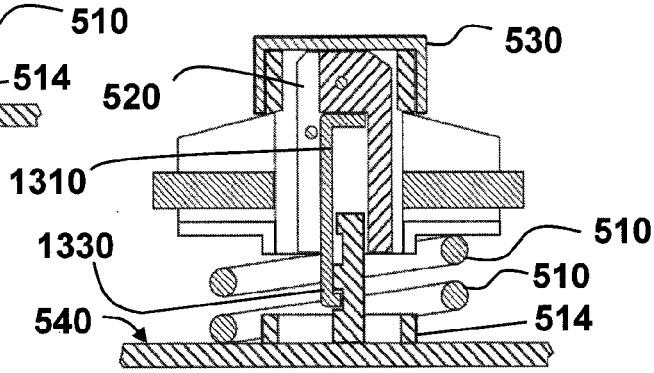

FIGS. 13-16 depicts, in cross-sections, an exemplary detent plunger. FIG. 13 depicts in cross-sectional view a base portion of and exemplary plunger where the U-shaped pawl 1310, supported by a pin 1320 is elevated away from the base 540, where the pawl 1310 is disengaged from the locking chevron protrusion 1330. FIG. 14 depicts in a cross-section view where the U-shaped pawl is depressed below a lower corner of the chevron protrusion, thereby retaining the depressed state of the upper portion of the base portion of the plunger. FIG. 15 depicts, in another cross-sectional view, the lower portion of the U-shaped pawl 1310 above the chevron 1330, thereby extending the travel of the base portion of the plunger to a travel stop 1331. FIG. 16 depicts, in another cross-sectional view, the lower portion of the U-shaped pawl 1310 engaging the chevron protrusion 1330, thereby retaining the depressed state of the upper portion of the of the plunger.

Figure 17:
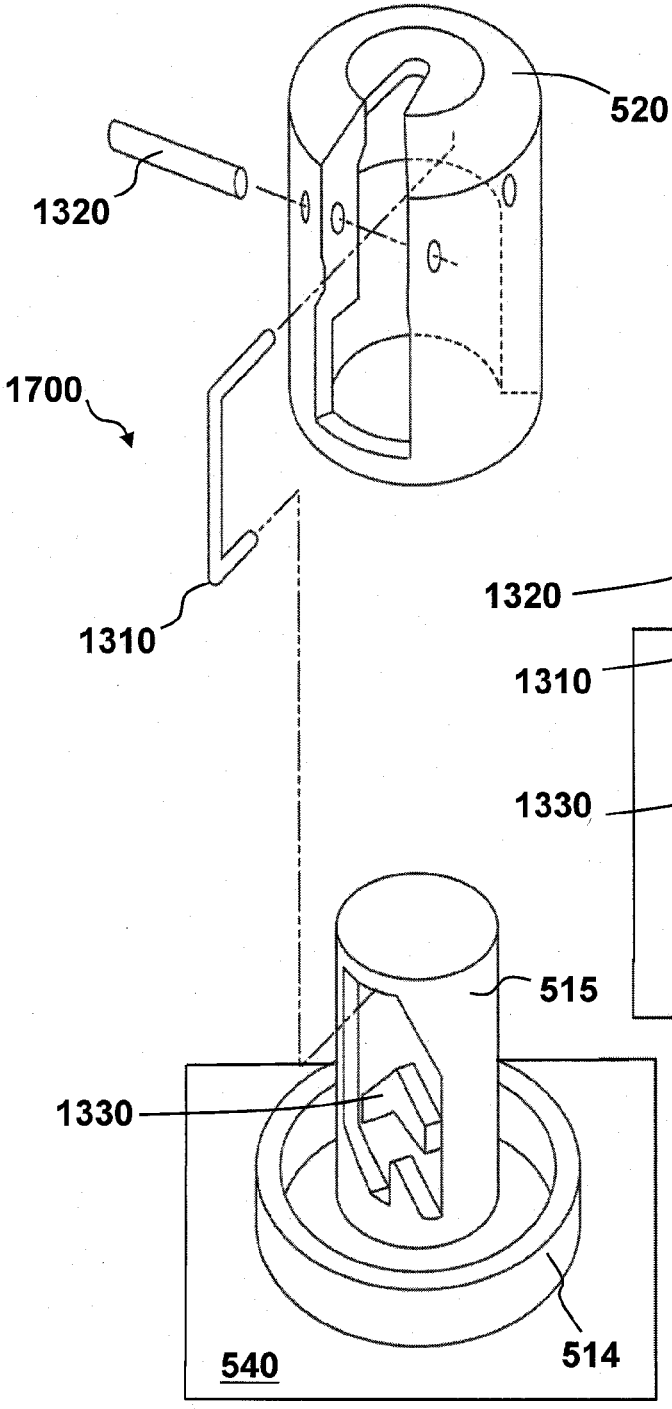
FIG. 17 depicts an exemplary exploded view of a base portion of an exemplary plunger.

FIG. 17 depicts the base portion of the plunger 1700 in an exploded view where the portion of the plunger 515 disposed on the base 540 comprises the chevron protrusion 1330 and where the upper portion of the plunger 520 comprises the U-shaped pawl 1310 and a pin 1320.

Figure 18:
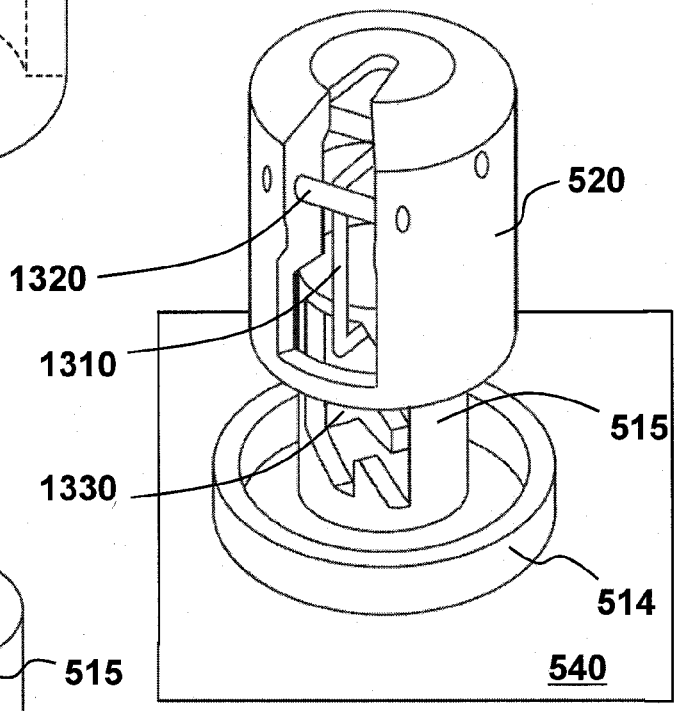
FIG. 18 depicts an exemplary base portion of a plunger.

FIG. 18 depicts the base portion of the plunger in a perspective view of an extended upper portion 520 relative to the base portion 515, where the portion of the plunger 515 disposed on the base 540 comprises the chevron protrusion 1330 and where the upper portion of the plunger 520 comprises the U-shaped pawl 1310 and a pin 1320.

Figure 19:
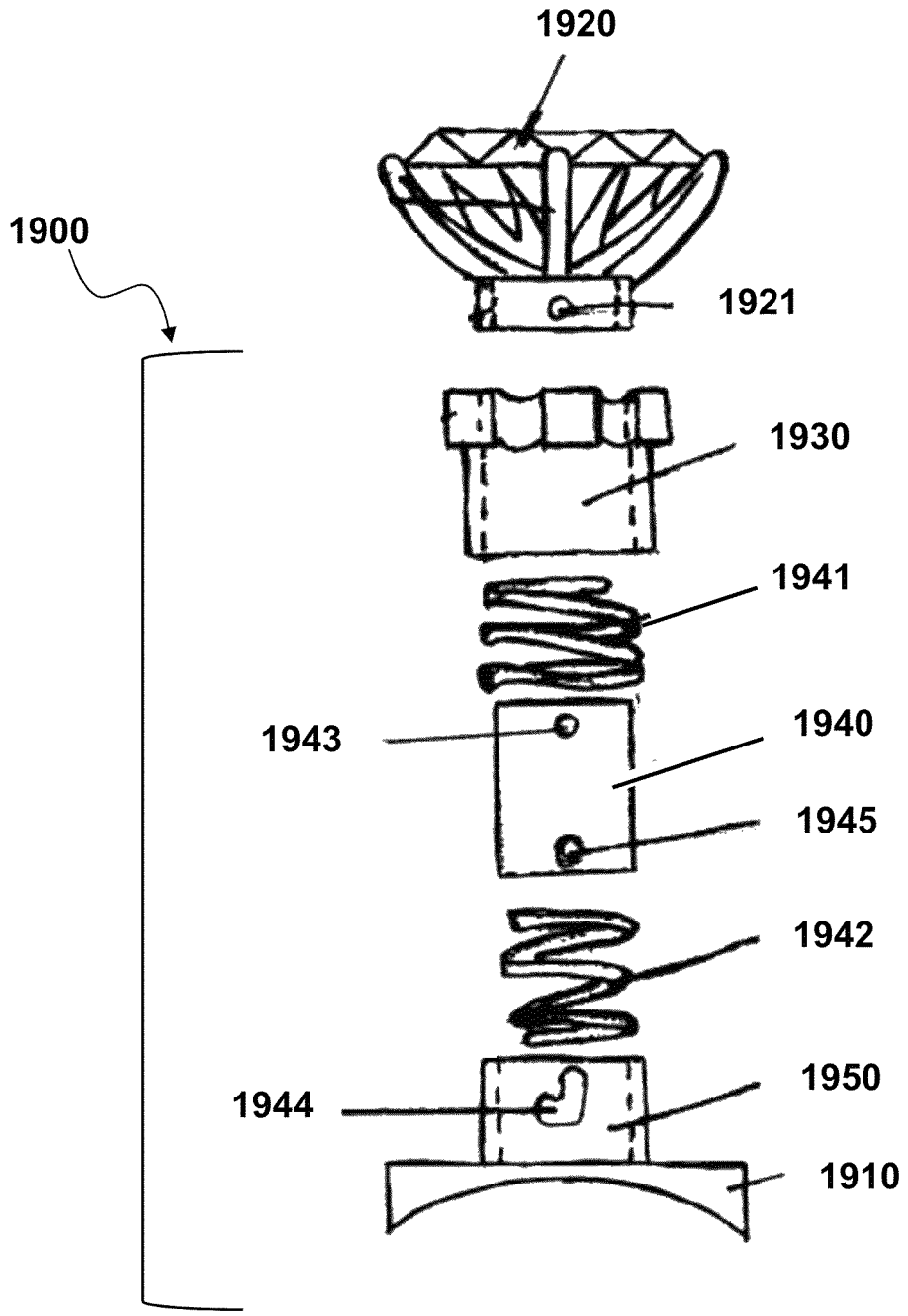
FIG. 19 is an exploded view of an alternative embodiment of a plunger assembly and base.

FIG. 19 is an exploded view of an alternative embodiment of a plunger assembly 1900 and base 1910. A cap portion 1920 comprises a first protrusion 1921, or first dimple, and slideably engages a first outer cylinder portion 1930 to compress a first resilient element 1941, e.g., a spring, via a first aperture 1943 of an inner cylinder 1940. The inner cylinder 1940 comprises a second protrusion 1945, and slideably engages a second outer cylinder 1950, disposed as the base 1910, to compress a second resilient element 1942, via a second aperture 1944 having an L-shaped slot to both longitudinally receive the second protrusion and rotatably lock the travel of the assembly under load from the two resilient elements.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention herein disclosed by way of examples should not be limited by the particular disclosed embodiments described above.

What is claimed is:

1. A ring assembly comprising:

a plunger comprising a base portion and a cap portion;

a rotational element array assembly slidably disposed concentrically about the plunger base portion; and a resilient element interposed between the rotational element array and a base; and wherein the rotational element array assembly comprises a plurality of rotational structural elements wherein at least one of the plurality of rotational structural elements comprises:

a first aperture, and a second aperture, wherein the second aperture is disposed along a first lever arm portion of the at least one rotational structural element distal from the first aperture;

a first ring threading the first aperture; and a second ring threading the second aperture;

wherein the first ring is interposed between a first lever arm guide and a second lever arm guide; and wherein the second ring is interposed between a third lever arm guide and a fourth lever arm guide.

2. The ring assembly of claim 1 wherein the first aperture is a first eyelet and the second aperture is a second eyelet.

3. The ring assembly of claim 1 wherein at least one of the plurality of rotational structural elements comprises a portion extending from a portion of the rotational structural element proximal to the first aperture in a direction away from the base.

4. The ring assembly of claim 1 wherein the base portion of the plunger comprises a protrusion and a pawl, wherein the pawl is configured to change a positional state of the plunger from an elevated positional state to a depressed positional state by engaging the protrusion via longitudinal depression of the cap portion of the plunger.

5. The ring assembly of claim 1 wherein:

the first lever arm guide comprises a groove portion configured to retain laterally the first lever arm and an abutment portion configured to retain a portion of the first ring;

the second lever arm guide is configured to engage the first lever arm guide via an interstitial space and retain the first ring via an interdigitated housing portion formed via the first lever arm guide engaging the second lever arm guide;

the third lever arm guide comprises a groove portion configured to retain the first lever arm and an abutment portion configured to retain a portion of the second ring; and the fourth lever arm guide is configured to engage the third lever arm guide via an interstitial space and retain the second ring via an interdigitated housing portion formed via the third lever arm guide engaging the fourth lever arm guide.

6. The ring assembly of claim 1, wherein the cap portion is configured to engage longitudinally the base portion via at least one of: a detent and a cap portion protrusion configured to laterally engage a base portion slot.

7. The ring assembly of claim 1, wherein the base further comprises a restraining rim configured to rotationally and elevationally guide the rotational element array assembly relative to the base responsive to longitudinal depression of the cap portion of the plunger.

* * * * *